United States Patent [19]

Barbaras et al.

[11] Patent Number: 5,044,830

[45] **Date of Patent: * Sep. 3, 1991**

[54] GRAVITY BASE STRUCTURE FOR AN OFFSHORE PLATFORM IN ARTIC REGIONS

[75] Inventors: Gérard A. A. Barbaras, La Queue en Brie; Jean Pagés, Paris; Phillippe A. R. Dumas, Saint-Fargeau, all of France

[73] Assignee: Doris Engineering, Paris, France

[ * ] Notice: The portion of the term of this patent subsequent to Mar. 6, 2007 has been disclaimed.

[21] Appl. No.: 467,271

[22] Filed: Jan. 24, 1990

Related U.S. Application Data

[63] Continuation of Ser. No. 190,157, May 4, 1988, Pat. No. 4,906,138.

[30] Foreign Application Priority Data

May 13, 1987 [FR] France ..... 87 06711

[51] Int. Cl.[5] ..... E02D 27/38

[52] U.S. Cl. ..... 405/210; 405/211; 405/217

[58] Field of Search ..... 405/217, 204, 203, 210, 405/211

[56] References Cited

U.S. PATENT DOCUMENTS

| | | | |
|---|---|---|---|
| 3,708,987 | 1/1973 | Roulet et al. | 405/210 |
| 4,422,804 | 12/1983 | Gerklick, Jr. et al. | 405/211 X |
| 4,470,725 | 9/1984 | Kure et al. | 405/217 X |
| 4,478,537 | 10/1984 | Birdy et al. | 405/217 |
| 4,504,172 | 3/1985 | Clinton et al. | 405/217 |
| 4,576,519 | 3/1986 | Mast et al. | 405/217 X |

*Primary Examiner*—Dennis L. Taylor
*Assistant Examiner*—J. Russell McBee
*Attorney, Agent, or Firm*—Watson, Cole, Grindle & Watson

[57] ABSTRACT

A gravity base structure for an offshore platform having deck supporting columns extending from seabed to above seawater level includes bottom and top slabs having inner and outer protective walls extending between them with a lattice structure for transmitting impact energy from the outer wall to the inner wall. The deck supporting columns are substantialy free of means for transmitting impact energy from the inner and outer protective walls to them.

5 Claims, 5 Drawing Sheets

GRAVITY BASE STRUCTURE FOR AN OFFSHORE PLATFORM IN ARTIC REGIONS

This application is a continuation of application Ser. No. 190,157, filed 5/4/88 now U.S. Pat. No. 4,906,138.

BACKGROUND OF THE INVENTION

1. Field of the Invention

The invention relates to a gravity base structure for an offshore platform in arctic regions, the structure comprising a monolithic concrete caisson closed by a top slab and by a bottom slab resting on the sea bed, the caisson exhibiting at its circumference a configuration of vertical teeth capable of withstanding icebergs colliding with it and absorbing the impact energy.

2. The Prior Art

The exploitation of hydrocarbon fields in arctic seas, or in iceberg infected zones, entails many problems due to the danger of collision with extremely large icebergs.

Platforms are known which are capable of withstanding pack-ice by breaking the latter up on inclined parts provided over a height corresponding to the thickness of the ice layer, as described in Patent FR-A-2,562,112. However, such platforms are not well adapted to withstand the impacts of icebergs, the submerged part of which is extremely large and may hit the lower portion of the platform, causing the latter to slip on the sea bed, if not more serious destruction.

In order to prevent such accidents, defenses are provided at a distance from the platform with the purpose of modifying the course of the icebergs and moving them away from the protected region. However, this solution is extremely expensive and requires constant surveillance of the region in order, if necessary, to destroy the largest icebergs before they come into contact with the defenses.

U.S. Pat. No. 4,422,804 found a relatively simple solution for platforms which have to withstand the impact of large icebergs. The platform consists of a monolithic massive concrete structure exhibiting an array of cylindrical or prismatic compartments extending vertically from a foundation slab resting on the seabed and closed by a cover slab. This structure generally extends above the surface of the water and supports the deck by means of columns. The circumference of the structure exhibits pointed or rounded teeth extending vertically, which form a reinforced part of the external compartments thus forming the structure capable of withstanding the impacts of icebergs and possibly able to crush them.

The compartments have thick walls and occupy the totality of the structure. The walls stiffen the whole of the structure and participate in withstanding the forces. The great thicknesses of concrete are also subjected to substantial stresses due to the temperature of the oil stored in the compartments and require appropriate prestressed reinforcements.

SUMMARY OF THE INVENTION

The invention originates from the above-described device, but resists the external forces by a different device, does not involve the internal walls in withstanding and transmitting of the forces, and consequently reduces the weight of the structure and improves its marine stability; it likewise reduces the effects of the high temperature of the oil to be stored upon the materials forming the walls of the tanks. It achieves an appreciable reduction in the quantitites of the structural materials and the prestressing reinforcements.

The structure according to the invention is remarkable in that is incorporates at its circumference a double wall formed by two concentric walls mutually connected by vertical partition walls forming a lattice structure of triangular prisms, the outer concentric wall carrying the defensive elements.

The explanations and drawings given below as examples will permit an understanding of how the invention may be realized.

DETAILED DESCRIPTION OF THE PREFERRED EMBODIMENTS

Figure 1:
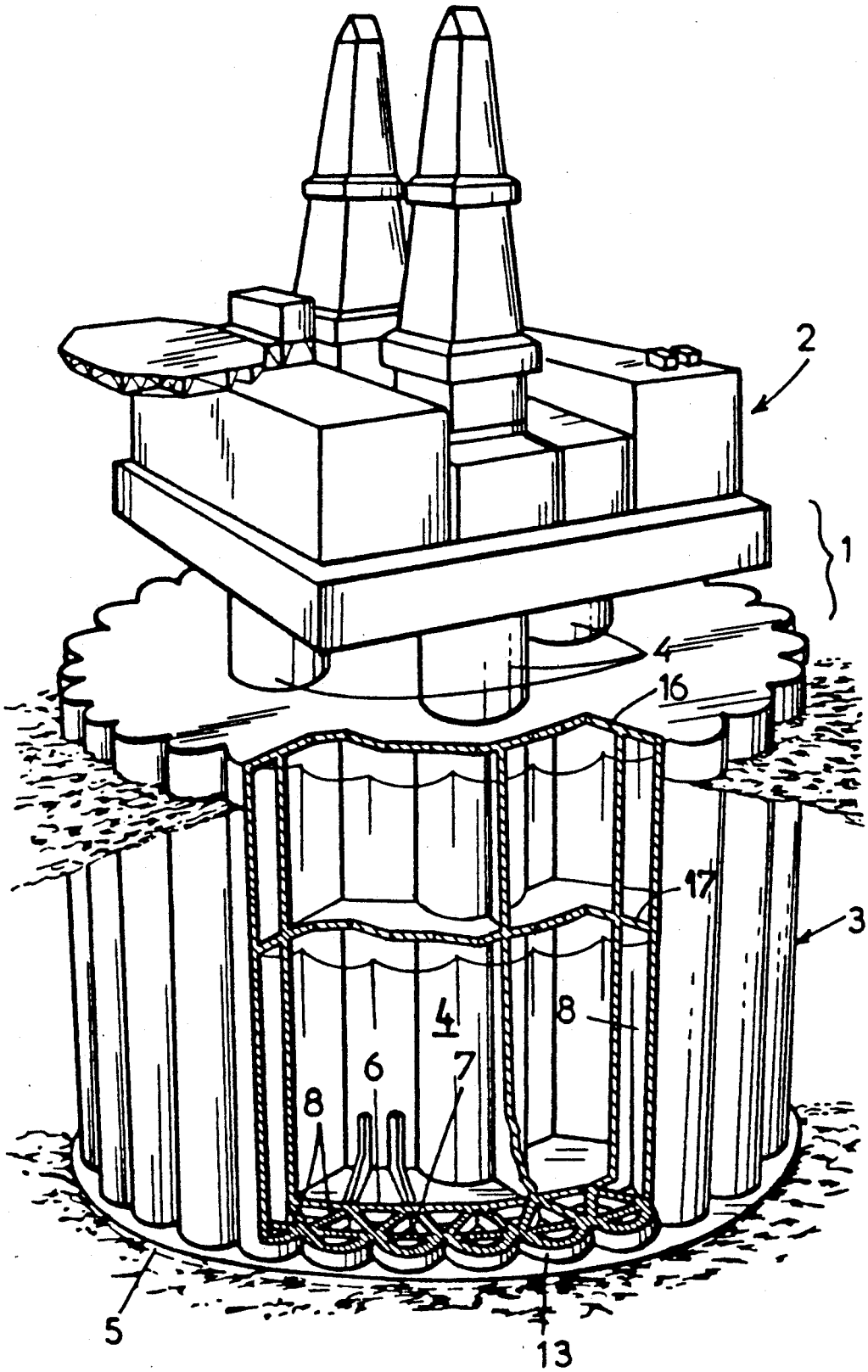
FIG. 1 is a partly broken-away perspective view of a structure according to a first embodiment of the invention.

FIG. 1 illustrates an oil production platform comprising a support structure 1 according to a first embodiment of the invention, resting on the seabed and supporting a deck 2 upon which the technical installations and the living quarters are arranged. Since the platform is intended to be used in arctic regions, the installations are sheltered and air-conditioned.

The support structure 1 consists of a caisson 3, from which rise one or more columns 4 supporting the deck 2.

The caisson 3 is a monolithic structure of cylindrical general shape, comprising a bottom slab 5 resting on the sea bed, upon which there rises, close to its circumference, a double wall formed by two concentric walls 6, 7 stiffened by a top slab 16. The two concentric walls 6, 7 are mutually connected by vertical partition walls 8 forming a lattice structure of triangular prisms, the sides of which formed by the outer or inner wall are optionally curvilinear.

According to the embodiment illustrated, the concentric walls are polygonal and the apices of one of the polygons are staggered by half a side with respect to the apices of the other polygon. The partition walls 8 connect the apex of a polygon to the adjacent apices of the other polygon.

Figure 2:
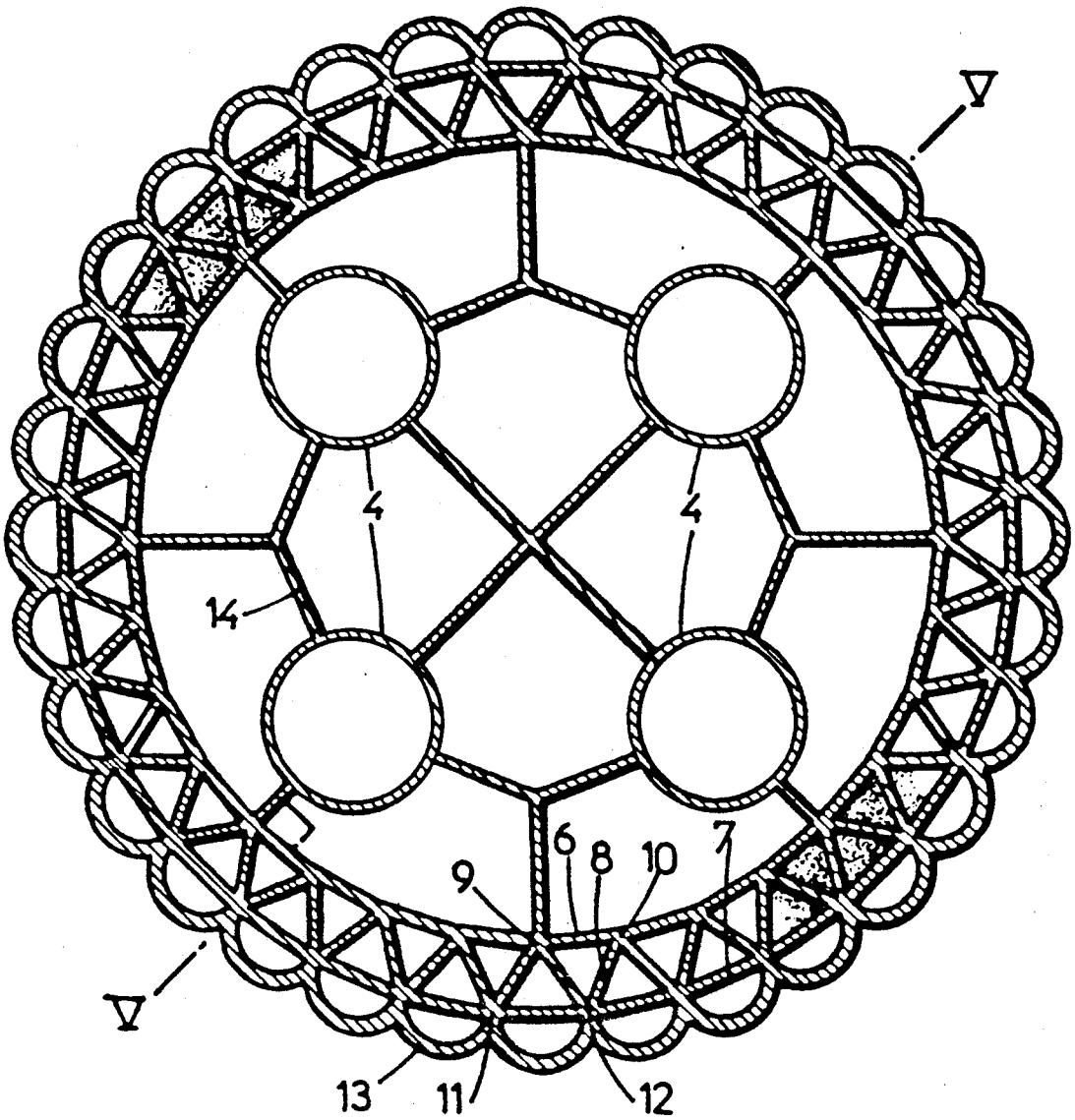
FIG. 2 is a plan sectional view of the structure according to FIG. 1.

These special features are shown clearly in FIG. 2, which is a cross-section of FIG. 1. Thus the wall 6 forming the inner polygon has its apices 9, 10 . . . staggered by half a side relative to the apices 11, 12 of the wall 7 forming the outer polygon. Each of the apices 9, 10 . . . of the inner polygon is connected to the adjacent apices 11, 12 of the outer polygon by partition walls 8 which constitute bracing means.

According to another form of embodiment not shown. the concentric walls 6, 7 are not similar and comprise a different number of sides. The vertical partition walls 8 are arranged in planes passing through the vertical axis of the structure or parallel thereto.

The outer wall 7 carries, centered on each side of the polygon, defensive elements 13 projecting outwards, which rest by their ends upon two consecutive apices of the corresponding polygon or partly curvilinear prism.

As known from U.S. Pat. No. 4,422,804, these elements may take the form of rounded, not necessarily circular, or sharp teeth.

The interior volume of the caisson limited by the inner wall is divided, depending upon the purpose of the platform, by internal partition walls 14 forming tanks intended to receive, for example, crude oil or various liquids, and/or providing compartments to be utilized for placing the ballast. This interior volume likewise accomodates the hollow column or columns 4 rising from the bottom slab 5 up to a top slab 16, then rising—in the example shown—above the latter to support the deck. These columns contain various equipment or materials related to the use of the structure.

The internal partition walls 14, which delimit the inner compartments, do not necessarily participate in the strength of the structure, which is due essentially to the double lattice circumference wall and to the bottom and top slabs. To prevent them from participating in the transmission of forces, the internal partition walls 14 may be equipped with flexible joints at their ends.

The structure is made in a well known manner of reinforced and prestressed concrete, or totally or partly in lightweight concrete, i.e., concrete having a density of about 1900 kg/m$^3$, and it may be composed of a high-strength material.

The ballast is placed in the compartments or tanks provided and in the compartments of the outer double wall and in the defensive elements, and may consists of seawater, sand, stones, heavy ores or any other pulverulent product.

In order to increase the weight of the platform, and likewise in order to reinforce or stiffen the whole or part of the concentric walls, the prismatic volumes formed between the double wall and the partition walls, and also the defensive elements 13, may be filled with a material, concrete for example, which solidifies.

As known, the defensive elements 13 are intended to endure direct contact with icebergs. The form of these elements is not essential; however, the quality of their support is very important because the forces which they resist are required to be transmitted harmoniously into the double wall which supports them.

In order to permit a better distribution of forces, it may be necessary to increase the rigidity of the caisson by providing one or more intermediate slabs 17 between the bottom and top slabs. Such slabs, like the bottom and top slabs, may be locally reinforced by overthicknesses or by stiffening beams.

Figure 3:
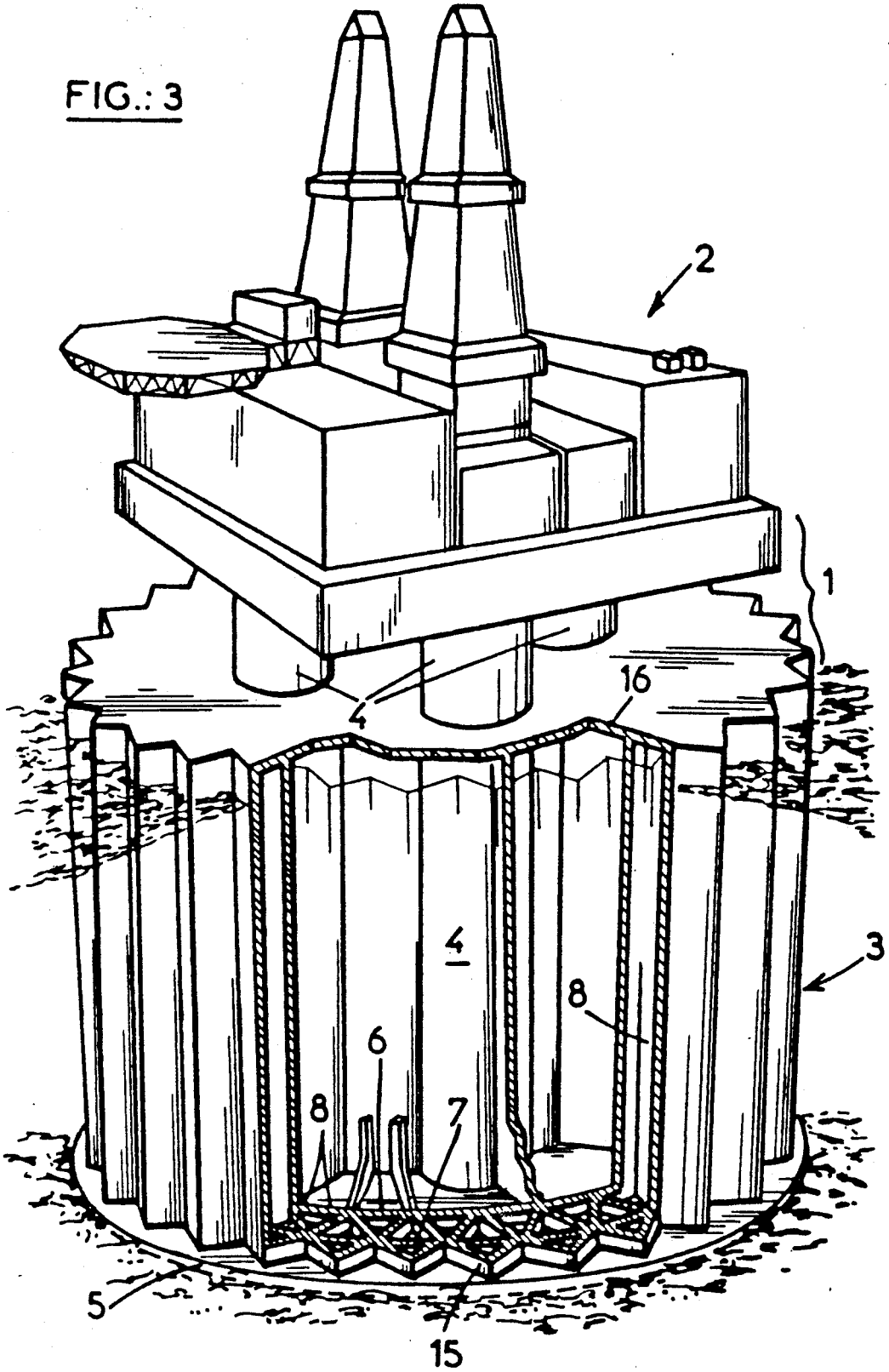
FIG. 3 is a partly broken-away perspective view of a structure according to a second embodiment of the invention.
Figure 4:
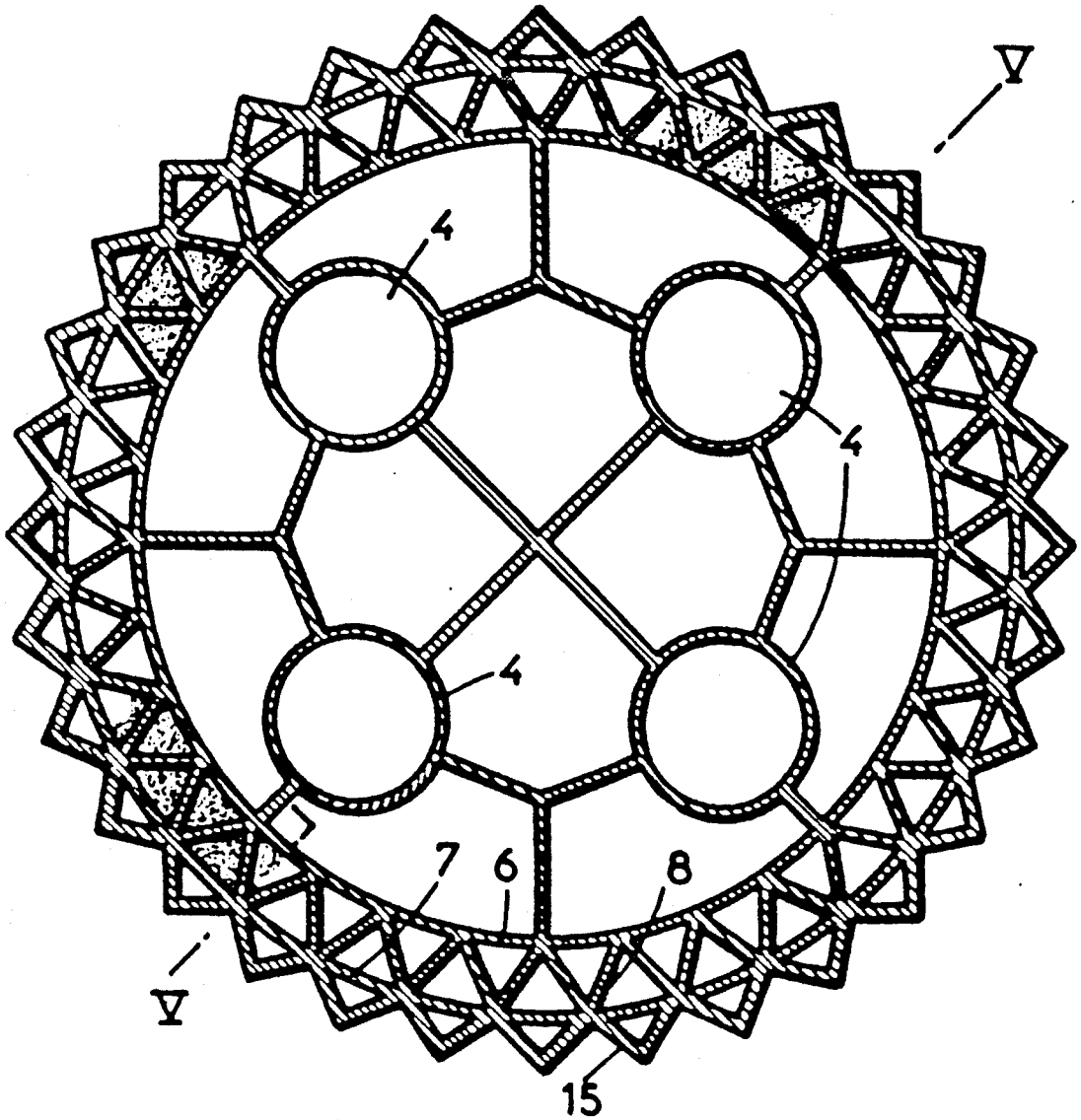
FIG. 4 is a plan sectional view of the structure according to FIG. 3.

FIGS. 3 and 4 illustrate a second embodiment of caisson according to the invention, wherein the concentric walls 6, 7 are circular and the defensive elements 15 feature a triangular cross-section. The apices of the bases of the triangles coincide with the intersections of the partition walls 8 and of the wall 7.

Figure 5:
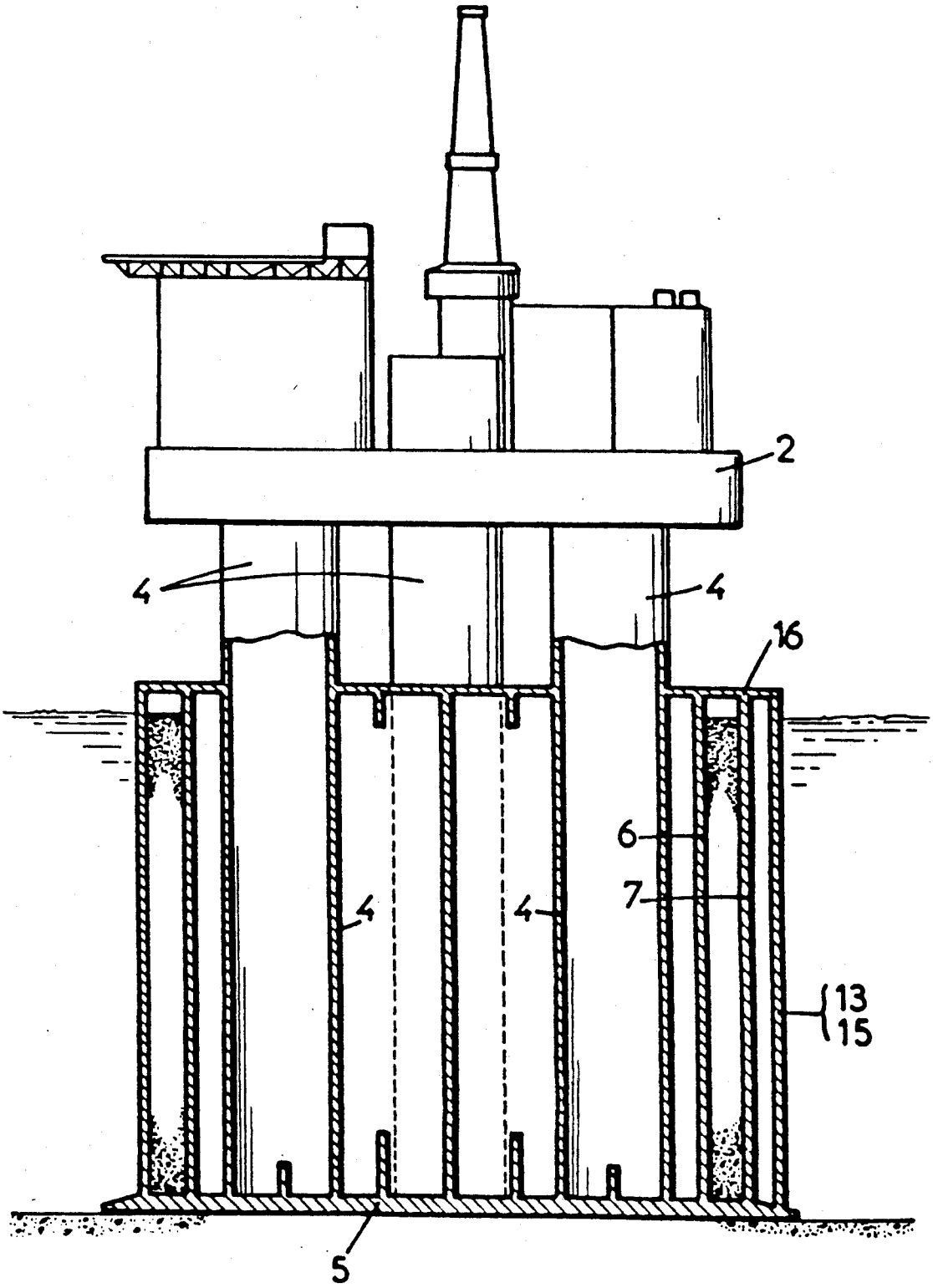
FIG. 5 is a vertical section view along the line V—V of FIGS. 2 and 4.

FIG. 5 shows a sectional view along the line V—V of FIGS. 2 and 4.

Due to the arrangement of the circumference of the caisson in the form of a braced double wall forming an annular lattice structure, the forces to which the defensive elements are subjected in the case of an impact by an iceberg are distributed uniformly in the structure and therefore allow a substantial reduction in the weight of the caisson compared to the concept described in U.S. Pat. No. 4,422,804.

According to an embodiment relating to a platform intended to be installed in a depth of 80 meters of water, and of similar dimensions to that of the platform according to the prior art, the saving in weight for the concrete and the structural steel is of the order of 10 to 15%, and for the prestressing cables from 15 to 25%.

This reduction in the mass of the structure presents numerous advantages. The reduction of the volume of concrete forming the internal partition walls and tanks, walls which in the prior art served to spread the forces intercepted by the defensive elements, reduces the effects due to the high temperature of the stored oil upon the materials, and in particular upon the prestressing reinforcements.

The reduction in the weight of the caisson improves the marine stability and permits a substantial increase in the head load during towing. This higher head load capacity permits auxiliary equipment to be installed on the deck under the favorable conditions existing at the construction site of the platform, and therefore reduction in costs associated with the installation and connection of the same equipment in offshore conditions.

Another advantage consists in the possibility of arranging the columns 4 and the internal partition walls 14 totally independently of the configuration of the double outer wall. The arrangement of this double wall and of its defenses, since it no longer depends upon the array of inner walls, can be optimized as a function of iceberg impacts; for example, it is easy to reduce or increase the number of defenses, or to change their dimensions.

We claim:

1. A gravity base structure which can extend from a seabed to above seawater level and protect from iceberg impact the deck of an offshore platform having supporting columns extending from seabed to above seawater level, comprising a monolithic concrete caisson which includes a bottom slab adapted to rest on the seabed, a top slab spaced upwardly therefrom, an inner protective wall which extends between said bottom slab and said top slab and is integral with both said slabs, an outer protective wall which extends between said bottom slab and said top slab and is integral with both said slabs, said outer wall being substantially concentric with said inner wall, and a plurality of partition walls which extend between said bottom slab and said top slab and from said inner wall to said outer wall to form therebetween a lattice structure for transmitting impact energy from said outer wall to said inner wall, said deck supporting columns being substantially free of means for transmitting impact energy to said columns from said inner and outer protective walls other than that transmitted by said top and bottom slabs.

2. A gravity base structure as claimed in claim 1, wherein said inner and outer walls are formed of interconnected straight wall sections.

3. A gravity base structure as claimed in claim 1, wherein said inner and outer walls are cylindrical and coaxial with each other.

4. A gravity base structure as claimed in claim 1, wherein said caisson includes an intermediate slab located between said bottom and top slabs, said intermediate slab being integral with said inner and outer protective walls.

5. A gravity base structure as claimed in claim 1, wherein said lattice structure is comprises of generally triangular prisms.

* * * * *